US008948403B2

(12) United States Patent
Lee et al.

(10) Patent No.: US 8,948,403 B2
(45) Date of Patent: Feb. 3, 2015

(54) METHOD OF PROCESSING SIGNAL, ENCODING APPARATUS THEREOF, DECODING APPARATUS THEREOF, AND SIGNAL PROCESSING SYSTEM

(75) Inventors: Nam-suk Lee, Suwon-si (KR); Jong-hoon Jeong, Suwon-si (KR); Han-gil Moon, Seoul (KR); Hyun-wook Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 788 days.

(21) Appl. No.: 13/204,179

(22) Filed: Aug. 5, 2011

(65) Prior Publication Data

US 2012/0035939 A1 Feb. 9, 2012

Related U.S. Application Data

(60) Provisional application No. 61/371,294, filed on Aug. 6, 2010.

(30) Foreign Application Priority Data

Jun. 2, 2011 (KR) ..... 10-2011-0053369

(51) Int. Cl.

| | |
|---|---|
| ***H04R 5/00*** | (2006.01) |
| ***G10L 19/00*** | (2013.01) |
| ***G10L 19/008*** | (2013.01) |
| ***H04S 3/00*** | (2006.01) |

(52) U.S. Cl.

CPC ..... *G10L 19/008* (2013.01); *H04S 3/008* (2013.01); *H04S 2400/03* (2013.01); *H04S 2420/03* (2013.01)

USPC ..... 381/19; 381/17; 704/500

(58) Field of Classification Search

CPC ..... G10L 19/008; G10L 19/20

USPC ..... 381/17–23

See application file for complete search history.

(56) References Cited

U.S. PATENT DOCUMENTS

| | | | | |
|---|---|---|---|---|
| 7,715,569 | B2 * | 5/2010 | Oh et al. | 381/22 |
| 8,417,531 | B2 * | 4/2013 | Kim et al. | 704/500 |
| 8,494,667 | B2 * | 7/2013 | Pang et al. | 700/94 |
| 2006/0190247 | A1 * | 8/2006 | Lindblom | 704/230 |
| 2008/0279388 | A1 * | 11/2008 | Oh et al. | 381/1 |
| 2009/0125313 | A1 * | 5/2009 | Hellmuth et al. | 704/501 |
| 2009/0125314 | A1 * | 5/2009 | Hellmuth et al. | 704/501 |
| 2011/0004479 | A1 * | 1/2011 | Ekstrand et al. | 704/500 |
| 2012/0035939 | A1 * | 2/2012 | Lee et al. | 704/500 |

FOREIGN PATENT DOCUMENTS

| | | | |
|---|---|---|---|
| KR | 2000-0014812 | A | 3/2000 |
| KR | 10-2007-0003593 | A | 1/2007 |

* cited by examiner

*Primary Examiner* — Samuel G Neway

(74) *Attorney, Agent, or Firm* — Sughrue Mion, PLLC

(57) ABSTRACT

A method processing a signal, an encoding apparatus, and a decoding apparatus are provided. The method of processing a signal includes restoring a down-mixed original signal using a re-quantized prediction parameter to generate a restored signal in an encoding apparatus; generating mute information indicating whether the down-mixed original signal has been muted, according to a value of the restored signal; and transmitting the mute information and the down-mixed original signal from the encoding apparatus to a decoding apparatus.

22 Claims, 7 Drawing Sheets
(1 of 7 Drawing Sheet(s) Filed in Color)

METHOD OF PROCESSING SIGNAL, ENCODING APPARATUS THEREOF, DECODING APPARATUS THEREOF, AND SIGNAL PROCESSING SYSTEM

CROSS-REFERENCE TO RELATED APPLICATION

This application claims the benefit of U.S. Application No. 61/371,294, filed on Aug. 6, 2010 in the U.S. Patent and Trademark Office, and Korean Patent Application No. 10-2011-0053369, filed on Jun. 2, 2011 in the Korean Intellectual Property Office, the disclosures of which are incorporated by reference herein in their entirety.

BACKGROUND

1. Field

Methods and apparatuses consistent with exemplary embodiments relate to encoding and decoding signals, and more particularly, to processing a signal by which a sound quality deterioration occurring in down-mixing can be reduced.

2. Description of the Related Art

In order to realize a stereophonic and realistic audio system, a multichannel audio device has been developed. In more detail, an audio system, which outputs a plurality of audio channel signals through a plurality of speakers, respectively, e.g., a 2 channel or a 5.1 channel audio system, has come into wide use.

A case where the number of channels is to be reduced to encode multichannel audio signals may occur. For example, a 5.1 channel audio system includes a front left speaker, a front right speaker, a front center speaker, a back left speaker, a back right speaker, and a sub-woofer. The 5.1 channel audio system divides and outputs the multichannel audio signals through the above speakers, respectively. It may be advantageous in some cases for multichannel audio signals including a plurality of audio signals to be encoded by reducing the number of channels. For example, a 5.1 channel signal that is a multichannel audio signal may be output through two speakers. Alternatively, the 5.1 channel signal may be transmitted through 4 audio channels.

If the number of speakers or the number of transmission channels is lower than the number of channels of the audio signal, the number of channels of a multichannel audio signal is to be reduced to encode the multichannel audio signal. Encoding which reduces the number of channels is referred to as down-mixing.

However, if down-mixing is performed, a quantization error and a prediction error may occur when a decoder decodes an encoded audio signal. As a result, a section in which an audio signal is not appropriately restored occurs, and thus sound quality is deteriorated. In more detail, if an audio signal is not appropriately restored, discontinuity of the audio signal occurs in a corresponding section.

SUMMARY

One or more exemplary embodiments provide a method of processing a signal by which a sound quality deterioration can be reduced, an encoding apparatus thereof, a decoding apparatus thereof, and a signal processing system.

One or more exemplary embodiments also provide a method of processing a signal by which discontinuity of an audio signal occurring in down-mixing can be removed, an encoding apparatus thereof, a decoding apparatus thereof, and a signal processing system.

According to an aspect of an exemplary embodiment, there is provided a method of processing a signal, the method including: restoring a down-mixed original signal using a re-quantized prediction parameter to generate a first restored signal in an encoding apparatus; generating mute information indicating whether the down-mixed original signal has been muted, according to a value of the first restored signal; and transmitting the mute information and the down-mixed original signal from the encoding apparatus to a decoding apparatus.

The method may further include determining whether the value of the first restored signal has a mute signal value corresponding to a mute state, wherein the generation of the mute information includes generating the mute information if the value of the first restored signal has the mute signal value.

The determination as to whether the value of the first restored signal has the mute signal value may include determining whether the value of the first restored signal has a value of 0.

The transmission of the mute information to the decoding apparatus may include transmitting the mute information to the decoding apparatus if the value of the first restored signal has the mute signal value.

The method may further include: determining a prediction parameter which is applied to up-mix the original signal in the encoding apparatus; quantizing the prediction parameter; and re-quantizing the quantized prediction parameter to produce the re-quantized prediction parameter.

The method may further include: restoring the down-mixed original signal using the prediction parameter in the decoding apparatus to generate a second restored signal; determining whether discontinuity has occurred in the second restored signal; and changing the second restored signal according to the determination result and the mute information.

If the discontinuity has occurred in the second restored signal, the method may further include determining whether the original signal has been muted, based on the mute information.

The changing the second restored signal may include if it is determined that the original signal has not been muted, changing the value of the second restored signal in a section in which the discontinuity has occurred.

The changing the second restored signal may include changing a value of the prediction parameter; and restoring the down-mixed original signal using the changed prediction parameter to generate a final restored signal.

The changing the second restored signal may include changing the second restored signal in a section in which the discontinuity has occurred, to one of the second restored signal in a previous section and the second restored signal in a subsequent section.

The changing the second restored signal may include changing the second restored signal in a section in which the discontinuity has occurred, to a value obtained by interpolating the second restored signal in a previous section and the second restored signal in a subsequent section.

The method may further include: extracting a quantized prediction parameter in the decoding apparatus; and re-quantizing the quantized prediction parameter, wherein the restoration of the down-mixed original signal comprises restoring the down-mixed original signal using the re-quantized prediction parameter.

According to an aspect of another exemplary embodiment, there is provided an encoding apparatus including: an encoder which down-mixes an original signal; and a controller which restores the down-mixed original signal using a re-quantized prediction parameter to generate a restored signal, generates mute information indicating whether the original signal has been muted, according to a value of the restored signal, and transmits the mute information and the down-mixed original signal to a decoding apparatus.

According to an aspect of another exemplary embodiment, there is provided a decoding apparatus including: a decoder which receives a down-mixed original signal and mute information indicating whether the original signal has been muted and restores the down-mixed original signal using a prediction parameter; and a controller which determines whether a discontinuity has occurred in the restored signal and changes a value of the restored signal according to the determination result and the mute information.

According to an aspect of another exemplary embodiment, there is provided a signal processing system including an encoding apparatus for down-mixing an original signal and a decoding apparatus for up-mixing the down-mixed original signal to generate a final restored signal.

The encoding apparatus may up-mix the down-mixed original signal using a re-quantized prediction parameter to generate a first restored signal, generate mute information indicating whether the original signal has been muted, according to a value of the first restored signal, and transmit the mute information and the down-mixed original signal to the decoding apparatus. The decoding apparatus may restore the down-mixed original signal using the prediction parameter to generate a second restored signal, determine whether discontinuity has occurred in the second restored signal, and change the restored signal according to the determination result and the mute information to generate the final restored signal.

According to an aspect of another exemplary embodiment, there is provided a decoding method including: receiving a down-mixed original signal and mute information that indicated whether an original signal has been muted; restoring the down-mixed original signal to produce a restored signal; for a least one section of a plurality of sections of the restored signal, determining whether a discontinuity has occurred in the section by comparing the value of the restored signal in the section with 0; and if a discontinuity has occurred in the section and the mute information indicates that the original signal has not been muted, changing the value of the restore signal in the section to remove the discontinuity.

BRIEF DESCRIPTION OF THE DRAWINGS

The patent or application file contains at least one drawing executed in color. Copies of this patent or patent application publication with color drawing(s) will be provided by the Office upon request and payment of the necessary fee. The above and other aspects will become more apparent by describing in detail exemplary embodiments with reference to the attached drawings in which.

DETAILED DESCRIPTION

Exemplary embodiments will now be described in detail with reference to the attached drawings.

There will now be described an encoding apparatus which down-mixes a multichannel audio signal including a plurality of audio signals and a decoding apparatus which up-mixes the down-mixed multichannel audio signal to restore the down-mixed multichannel audio signal to its original state.

Figure 1:
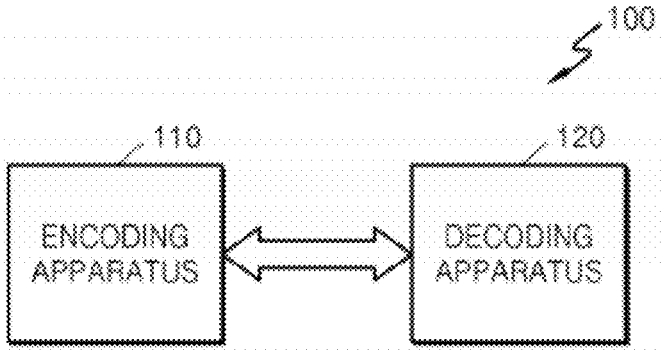
FIG. 1 is a block diagram of a signal processing system including an encoding apparatus and a decoding apparatus according to an exemplary embodiment.

FIG. 1 is a block diagram of a signal processing system 100 including an encoding apparatus 110 and a decoding apparatus 120 according to an exemplary embodiment.

Referring to FIG. 1, the signal processing system 100 includes the encoding apparatus 110 and the decoding apparatus 120. Hereinafter, a multichannel audio signal input into the encoding apparatus 110 is referred to as an original signal, and a signal which is restored and finally output by the decoding apparatus 120 is referred to as a final restored signal. Hereinafter, restoring is used as synonymous with up-mixing.

The encoding apparatus 110 receives, down-mixes, and outputs the original signal which is the multichannel audio signal including a plurality of audio signals.

The encoding apparatus 110 restores the down-mixed original signal using a re-quantized prediction parameter to generate a restored signal.

The encoding apparatus 110 generates mute information indicating whether the original signal has been muted, according to a value of the restored signal and transmits the mute information and the down-mixed original signal to the decoding apparatus 120. The encoding apparatus 110 also transmits a quantized prediction parameter to the decoding apparatus 120.

Here, a prediction parameter denotes a parameter which is applied to restore a down-mixed original signal to an original signal. In more detail, the prediction parameter is a value which is related to a down-mix matrix, coefficient values of the down-mix matrix, etc. used to down-mix the original signal. The prediction parameter may vary according to product and design specifications, etc. of the encoding apparatus 110 and the decoding apparatus 120 and may be experimentally set to an optimized value.

The encoding apparatus 110 determines a prediction parameter which will be used in up-mixing. The encoding apparatus 110 quantizes the determined prediction parameter and transmits the quantized prediction parameter to the decoding apparatus 120. The prediction parameter transmitted from the encoding apparatus 110 is used by the decoding apparatus 120 to restore the down-mixed original signal.

The decoding apparatus 120 restores the down-mixed original signal using the prediction parameter transmitted from the encoding apparatus 110 to generate the restored signal. The decoding apparatus 120 determines whether discontinuity has occurred in the restored signal and changes the restored signal according to the determination result and the mute information transmitted from the encoding apparatus 110.

In more detail, the decoding apparatus 120 re-quantizes the quantized prediction parameter transmitted from the encoding apparatus 110. The decoding apparatus 120 restores, i.e., up-mixes, the down-mixed original signal using the re-quantized prediction parameter. The decoding apparatus 120 also changes a value of the restored signal in a section in which the discontinuity has occurred.

The encoding apparatus 110 and the decoding apparatus 120 of FIG. 1 will now be described in more detail with reference to FIGS. 2A and 2B.

Figure 2A:
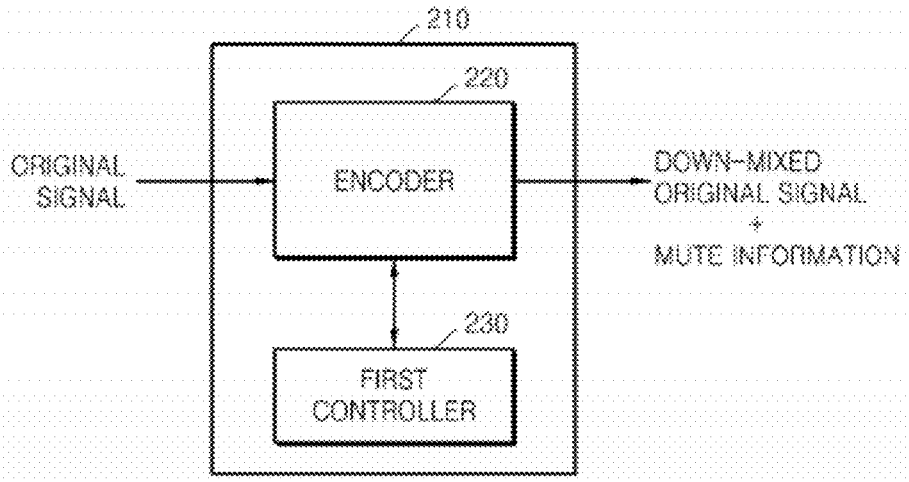
FIG. 2A is a block diagram of an encoding apparatus according to an exemplary embodiment.

FIG. 2A is a block diagram of an encoding apparatus 210 according to an exemplary embodiment. FIG. 2B is a block diagram of a decoding apparatus 250 according to an exemplary embodiment. The encoding apparatus 210 of FIG. 2A corresponds to the encoding apparatus 110 of FIG. 1, and the decoding apparatus 250 of FIG. 2B corresponds to the encoding apparatus 120 of FIG. 1. Therefore, overlapping descriptions of the encoding apparatus 210 and the decoding apparatus 250 of FIGS. 2A and 2B with those of the encoding apparatus 110 and the decoding apparatus 120 of FIG. 1 will be omitted.

FIG. 2A illustrates the encoding apparatus 210 according to an exemplary embodiment.

Referring to FIG. 2A, the encoding apparatus 210 includes an encoder 220 and a first controller 230.

The encoder 220 receives on original signal, down-mixes the signal, and outputs down-mixed original signal.

The first controller 230 controls the encoding apparatus 210 to restore the down-mixed original signal using a re-quantized prediction parameter so as to generate a restored signal. The first controller 230 also controls the encoding apparatus 210 to generate mute information indicating whether the original signal has been muted, according to a value of the restored signal and transmits the mute information and the down-mixed original signal to the decoding apparatus 250.

Hereinafter, the restored signal generated by the encoding apparatus 210 under control of the first controller 230 will be referred to as a first restored signal.

The first controller 230 controls the encoding apparatus 210 to determine a prediction parameter which will be used to up-mix the original signal, and quantizes and outputs the prediction parameter. Alternatively, the first controller 230 may quantize the prediction parameter. The first controller 230 also controls the encoding apparatus 210 to transmit the quantized prediction parameter to the decoding apparatus 250. The decoding apparatus 250 performs an up-mixing operation using the quantized prediction parameter transmitted from the encoding apparatus 210.

In more detail, the encoding apparatus 210 decodes the down-mixed original signal to restore the down-mixed original signal to a multichannel audio signal having the original number of channels. The down-mixed original signal is transmitted to the decoding apparatus 250 and has a lower number of channels than the number of channels of the original signal. The first restored signal generated by the encoding apparatus 210 has the same number of channels as the number of channels of the original signal.

In more detail, the first controller 230 determines whether the value of the first restored signal has a mute signal value corresponding to a mute state. If it is determined that the value of the first restored signal has the mute signal value, the first controller 230 generates the mute information.

The mute signal value indicates a signal value indicating that an audio signal is muted, i.e., may have a value of 0. A signal value range, which includes a part of peripheral noise but is regarded as being muted, may be set to a range of the mute signal value in consideration of environments of an audio system or an encoding apparatus.

The mute signal value of 0 will now be described.

In more detail, if the value of the first restored signal is 0, the first controller 230 generates mute information of the original signal. Here, the mute information indicates whether the original signal has been muted and may include a flag. In other words, if the original signal has been muted, a value of the flag may be set to 1. If the original signal has not been muted, the value of the flag may be set to 0.

If the flag is transmitted to the mute information, a number of bits transmitted to the decoding apparatus 250 may be minimized. As a result, the mute information may be transmitted with a minimized amount of transmitted data.

If the value of the first restored signal is not 0, the first controller 230 does not generate the mute information. The first controller 230 transmits only the down-mixed original signal to the decoding apparatus 250 and does not transmit the mute information to the decoding apparatus 250.

Figure 2B:
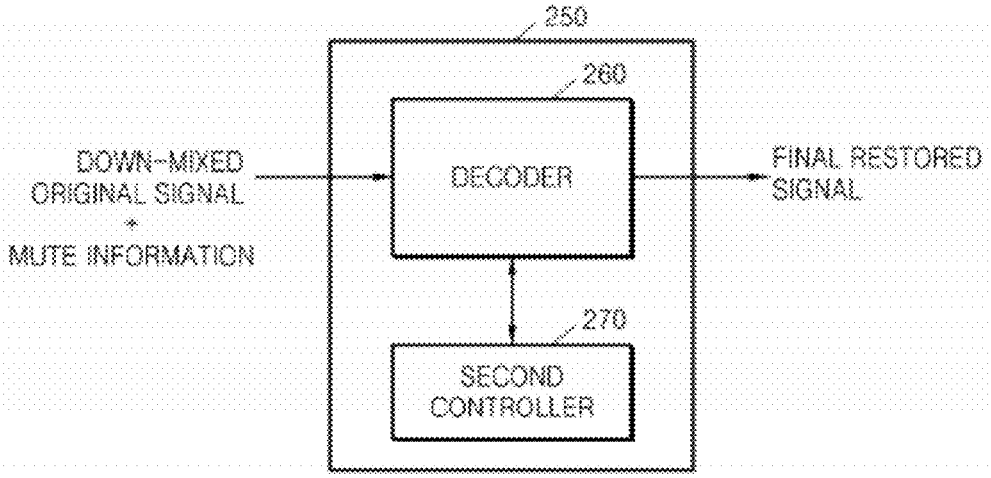
FIG. 2B is a block diagram of a decoding apparatus according to an exemplary embodiment.

FIG. 2B illustrates the decoding apparatus 250 according to an exemplary embodiment.

Referring to FIG. 2B, the decoding apparatus 250 includes a decoder 260 and a second controller 270.

The decoder 260 receives the down-mixed original signal and the mute information indicating whether the original signal has been muted, from the encoding apparatus 210. The decoder 260 also receives the prediction parameter for restoring the down-mixed original signal from the encoding apparatus 210. In more detail, the decoder 260 receives the prediction parameter which has been quantized. Here, restoring may be used as the same meaning as up-mixing. Also, the decoder 260 up-mixes, i.e., restores, the down-mixed original signal using the prediction parameter to generate a restored signal.

The second controller 270 determines whether discontinuity has occurred in the restored signal that is the restored original signal. The second controller 270 also changes a value of the restored signal according to the determination result and the mute information transmitted from the encoding apparatus 210. Here, discontinuity denotes that a restored signal does not temporally continue or does not exist in a certain time section. If the discontinuity occurs in the restored signal, sound is cut off and a silent period is reproduced when the restored signal is reproduced.

An example of an occurrence of discontinuity may include a loss of data in a certain section caused by a signal processing error, such as a quantization error or a prediction error. If an original signal has been muted and thus has a value of 0, discontinuity may occur in the original signal. In more detail, a restored signal that is audio data may have a value of 0 in a section in which discontinuity has occurred.

Here, a signal, which is finally output by the decoding apparatus 250 by changing a value of a restored signal in a section in which discontinuity has occurred, will be referred to as a final restored signal, and the restored signal having an unchanged value will be referred to as a second restored signal.

In more detail, if it is determined that the discontinuity has occurred in the second restored signal, the second controller 270 determines whether the original signal has been muted, based on the mute information. If it is determined that the original signal has not been muted, the second controller 270 changes a value of the second restored signal in the section in which the discontinuity has occurred. A structure for changing the value of the second restored signal will be described in detail later with reference to FIGS. 4 through 6.

The encoding apparatuses 110 and 210 and the decoding apparatuses 120 and 250 according to exemplary embodiments may perform methods of processing a signal, which will be described with reference to FIGS. 3 and 6.

Figure 3:
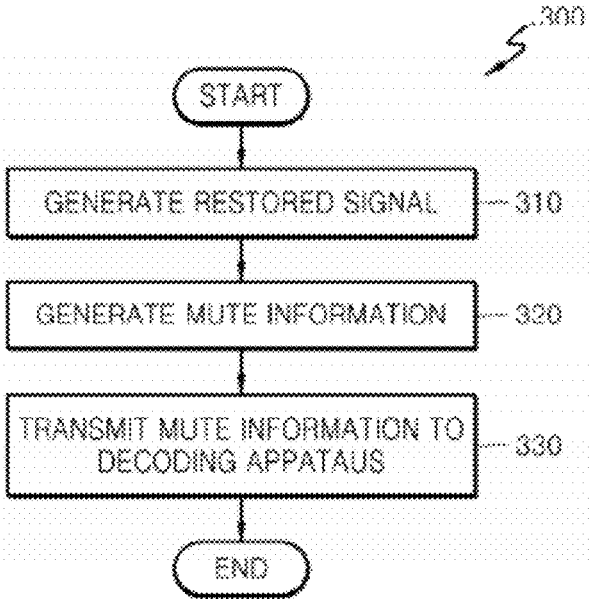
FIG. 3 is a flowchart illustrating a method of processing a signal according to an exemplary embodiment.

FIG. 3 is a flowchart illustrating a method 300 of processing a signal according to an exemplary embodiment. Referring to FIG. 3, the method 300 may be performed by the signal processing system 100 described with reference FIG. 1 and the encoding apparatuses 110 and 210 described with reference to FIGS. 1 and 2, and thus overlapping descriptions with those of FIGS. 1 and 2 will be omitted. Therefore, the method 300 will be described in detail with reference to FIGS. 2 and 3.

Referring to FIG. 3, in operation 310, a down-mixed original signal is restored using a re-quantized prediction parameter to generate a restored signal. Operation 310 may be performed by the first controller 230 of the encoding apparatus 210. Also, the restored signal generated in operation 310 corresponds to the first restored signal which has been described above.

In operation 320, mute information indicating whether an original signal has been muted is generated according to a value of the first restored signal generated in operation 310. In more detail, if the value of the first restored signal has a mute signal value corresponding to a mute state, the mute information is generated. If a value of the first restored signal does not have the muted signal value, the mute information is not generated. Also, the mute information may be generated in each section of the restored signal, e.g., in each frame. Operation 320 may be performed by the first controller 230 of the encoding apparatus 210.

In operation 330, the mute information and the down-mixed original signal are transmitted from the encoding apparatus 210 to the decoding apparatus 250. Operation 330 may be performed by the encoder 220 under control of the first controller 230 of the encoding apparatus 210.

Figure 4:
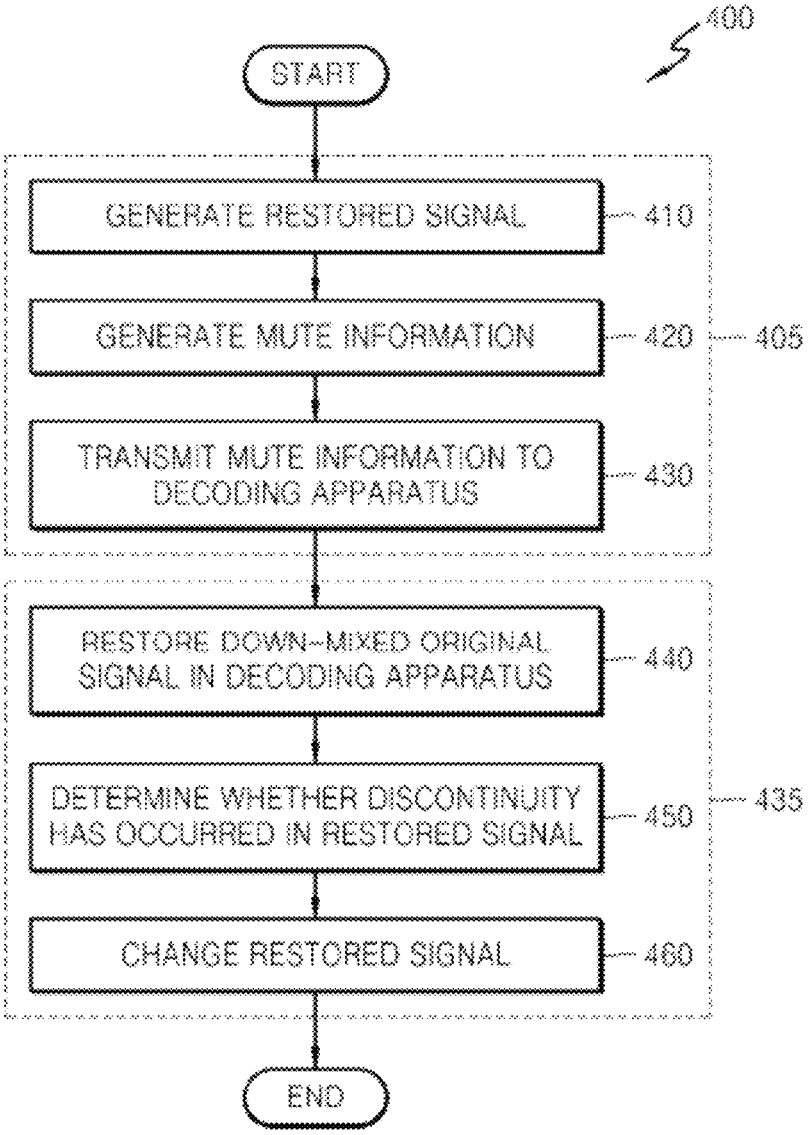
FIG. 4 is a flowchart illustrating a method of processing a signal according to another exemplary embodiment.

FIG. 4 is a flowchart illustrating a method 400 of processing a signal according to another exemplary embodiment. The method 400 of FIG. 4 further includes operations 440, 450, and 460 in comparison with the method 300 of FIG. 3. Operations 410, 420, and 430 respectively correspond to operations 310, 320, and 330 of FIG. 3, and thus overlapping descriptions of FIG. 4 with those of FIG. 3 will be omitted.

Operation block 435 of FIG. 4 may be performed by the signal processing system 100 of FIG. 1 and the decoding apparatuses 120 and 250 of FIGS. 1 and 2, and thus overlapping descriptions of FIG. 4 with those of FIGS. 1 and 2 will be omitted.

Referring to FIG. 4, in operation 440, the decoding apparatus 250 restores a down-mixed original signal using a prediction parameter. Operation 440 may be performed by the decoder 260 of the decoding apparatus 250, and a restored signal generated in operation 440 corresponds to the second restored signal which has been described above.

In operation 450, a determination is made as to whether discontinuity has occurred in the second restored signal that is the signal restored in operation 440. Operation 450 may be performed by the second controller 270.

In operation 460, a value of the second restored signal in a section in which the discontinuity has occurred is changed according to the determination result of operation 450 and mute information transmitted from the encoding apparatus 210. Operation 460 may be performed by the second controller 270.

In another operation (not shown), a final restored signal may be generated and output in consideration of the value of the second restored signal changed in operation 460. Operations for generating and outputting the final restored signal may be performed by the decoder 260.

Figure 5:
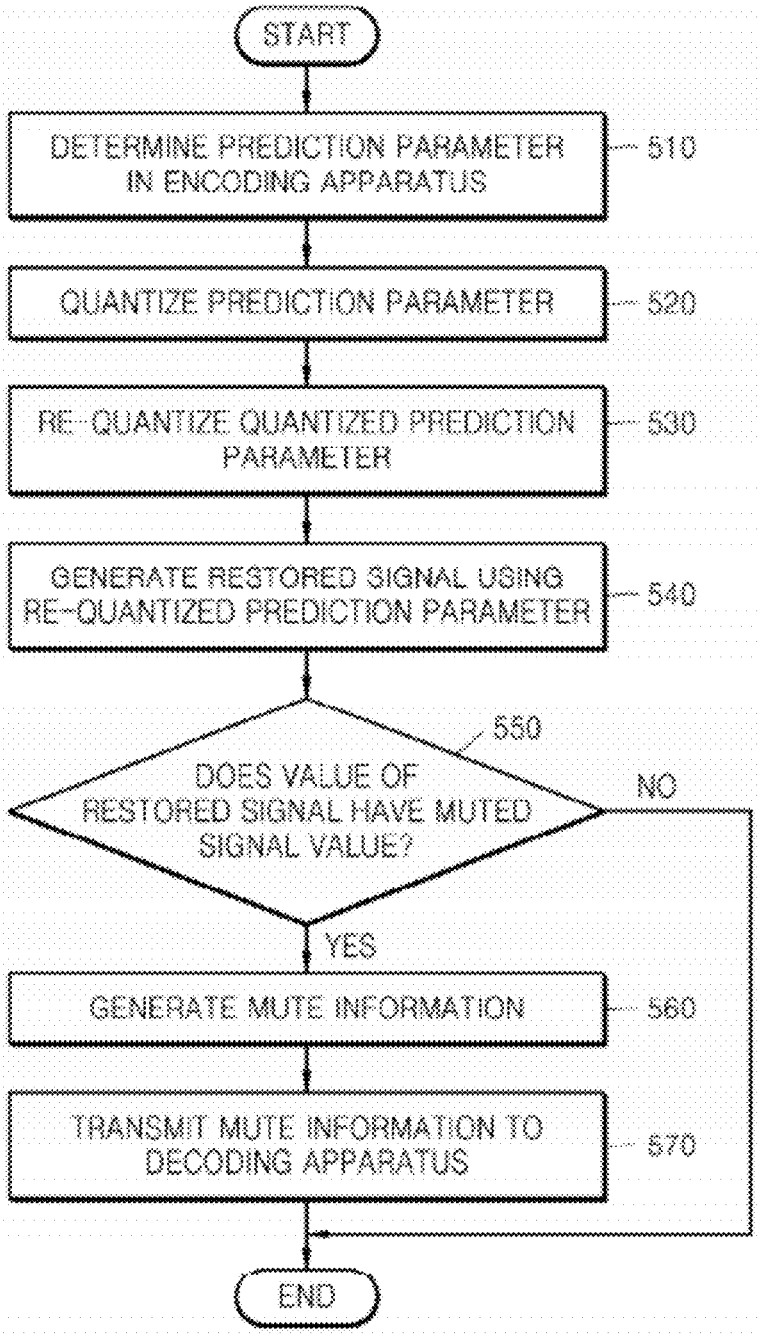
FIG. 5 is a flowchart illustrating a method of processing a signal according to another exemplary embodiment.

FIG. 5 is a flowchart illustrating a method 500 of processing a signal according to another exemplary embodiment. Operations 540, 560, and 570 of FIG. 5 respectively correspond to operations 310, 320, and 330 of FIG. 3, and thus overlapping descriptions of FIG. 5 with those of FIGS. 1, 2, and 3 will be omitted. Also, operations of FIG. 5 may be performed by the encoding apparatus 210.

In operation 510, the encoding apparatus 210 determines a prediction parameter applied to up-mix a down-mixed original signal. Operation 510 may be performed by the first controller 230.

In operation 520, the prediction parameter determined in operation 510 is quantized. Operation 520 may be performed by the first controller 230.

In operation 530, the prediction parameter quantized in operation 520 is re-quantized. Operation 530 may be performed by the first controller 230.

In operation 540, a first restored signal is generated using the prediction parameter re-quantized in operation 530. Operation 540 may be performed by the first controller 230.

In operation 550, a determination is made as to whether a value of the first restored signal generated in operation 540 has a muted signal value. Operation 550 may be performed by the first controller 230. The determination of operation 550 may be made in each section of the first restored signal, e.g., in each frame.

If it is determined in operation 550 that the value of the first restored signal has the mute signal value, mute information is generated in operation 560.

In operation 570, the mute information generated in operation 560 is transmitted to the decoding apparatus 250.

An encoding apparatus according to exemplary embodiments up-mixes a down-mixed original signal. If a first restored signal which the up-mixed signal has a signal value corresponding to mute state, the encoding apparatus generates mute information indicating whether an original signal has been muted. Therefore, if discontinuity occurs in a restored signal, a decoding apparatus can easily determine whether a discontinuity has occurred due to the original signal which is a muted signal or due to a signal processing error such as a quantization error or the like, using the mute information. Also, the decoding apparatus removes the discontinuity which has occurred in a restored signal which is not muted, using the mute information.

Accordingly, the encoding apparatus according to exemplary embodiments also can easily determine whether the restored signal has been muted so as to improve a sound quality in a subsequent signal processing, e.g., in up-mixing.

Figure 6:
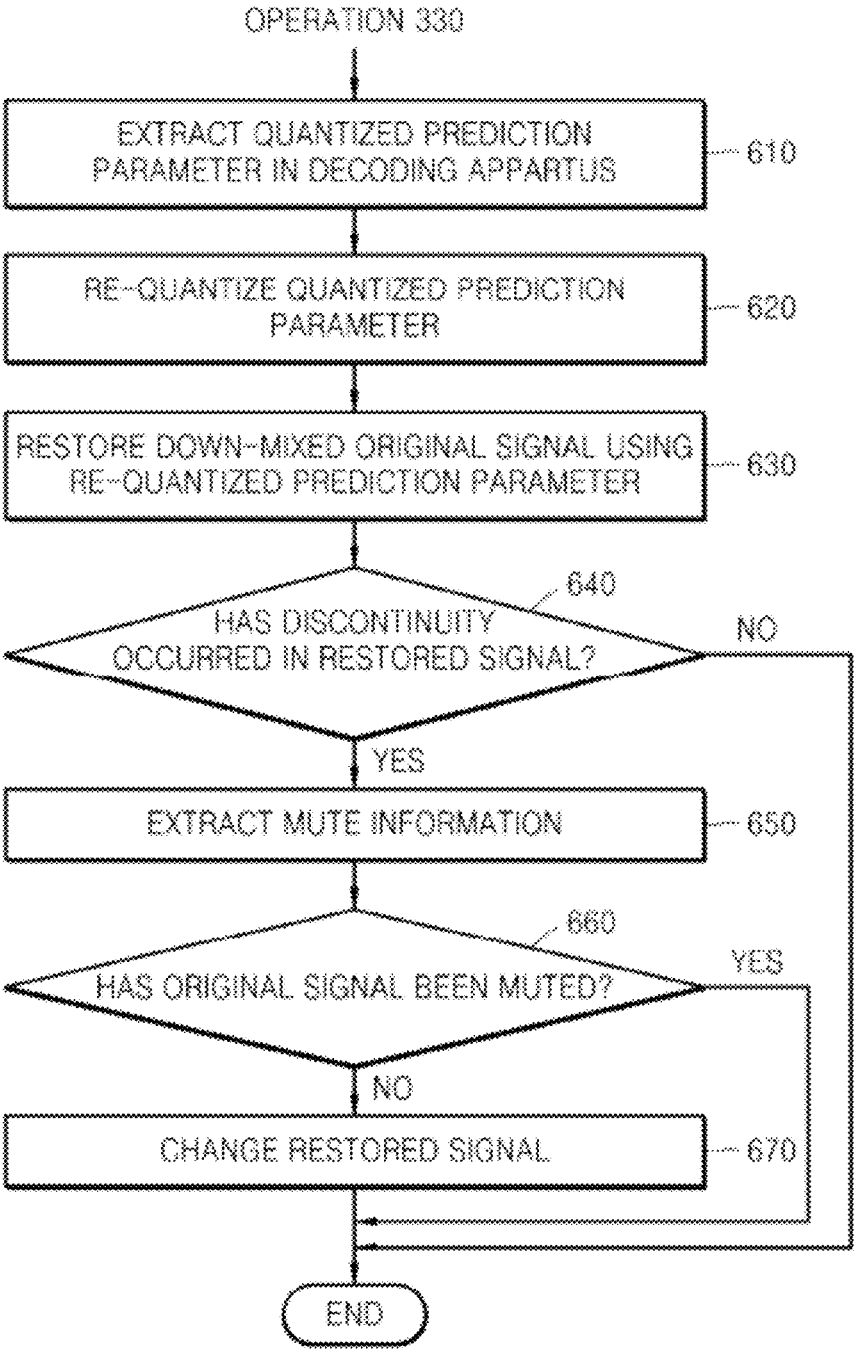
FIG. 6 is a flowchart illustrating a method of processing a signal according to another exemplary embodiment.

FIG. 6 is a flowchart illustrating a method of processing a signal according to another exemplary embodiment. The method of FIG. 6 illustrates operation block 435 of FIG. 4 in more detail, and operations 630, 640, and 670 of FIG. 6 respectively correspond to operations 440, 450, and 460 of FIG. 4. Therefore, overlapping descriptions of FIG. 6 with those of FIGS. 1, 2, and 4 will be omitted. Operations of FIG. 6 may be performed by the decoding apparatus 250.

Referring to FIG. 6, in operation 610, the decoding apparatus 250 extracts a quantized prediction parameter transmitted from the encoding apparatus 210. Operation 610 may be performed by the decoder 260 under control of the second controller 270.

In operation 620, the quantized prediction parameter is re-quantized.

In operation 630, the re-quantized prediction parameter generated in operation 620 is applied to a down-mixed original signal to generate a second restored signal that is a restored signal.

In operation 640, a determination is made as to whether discontinuity has occurred in the second restored signal. The determination as to whether the discontinuity has occurred in the restored signal may be made in each section of the restored signal. In more detail, if a value of the second restored signal is 0 in a section, it may be determined that the discontinuity has occurred in the restored signal. If the value of the restored signal is not 0 in the section, it may be determined that the discontinuity has not occurred in the restored signal.

If it is determined in operation 640 that the discontinuity has not occurred in the restored signal, the process ends.

If it is determined in operation 640 that the discontinuity has occurred in the restored signal, mute information transmitted from the encoding apparatus 210 is extracted in operation 650. Operation 650 may be performed by the second controller 270.

In operation 660, a determination is made as to whether the original signal has been muted, based on the mute information. In more detail, the determination may be made as to whether the original signal has been muted, according to a flag value of the mute information. If it is determined in operation 660 that the original signal has been muted, the process ends. Operation 660 may be performed by the second controller 270.

If it is determined in operation 660 that the original signal has not been muted, the value of the second restored signal in a section in which the discontinuity has occurred is changed in operation 670. Operation 670 may be performed by the second controller 270.

In more detail, operation 670 may further include an operation (not shown) for changing the prediction parameter and an operation (not shown) for applying the changed prediction parameter to the down-mixed original signal in the section in which the discontinuity has occurred, to generate a restored signal. The changed restored signal may be applied to generate a final restored signal.

In more detail, a random number may be added to a value of the prediction parameter to change the prediction parameter. Alternatively, half of quantization amplitude may be added to the prediction parameter to change the prediction parameter. If the prediction parameter is changed, the restored signal may be generated as another value, and the discontinuity may be removed. Here, the changed value of the prediction parameter may be experimentally optimized and set.

Operation 670 may further include an operation for changing the value of the second restored signal in the section in which the discontinuity has occurred, to a value which is obtained by interpolating a value of the second restored signal of a previous section into a value of the second restored signal of a subsequent section.

In other words, the value of the second restored signal in the section in which the discontinuity has occurred may be changed to a value obtained by interpolating signal values of previous and subsequent sections adjacent to a section in which discontinuity has occurred, so that the restored signal has continuity. In this case, if the interpolation value is used, continuity may be further naturally maintained.

Operation 670 may further include operation for changing the value of the second restored signal of the section in which the discontinuity has occurred, to one of values of the restored signal value of previous and subsequent sections.

As described above, a discontinuity occurring in a restored signal if an original signal is not a muted signal indicates that a signal processing error, such as a quantization error or a prediction error occurs. According to exemplary embodiments, in order to improve a discontinuity caused by a signal processing error and to improve a sound quality deterioration due to the discontinuity, a value of a restored signal of a section in which discontinuity has occurred is changed. Therefore, the discontinuity caused by the signal processing error is removed to improve the sound quality.

Figure 7A:
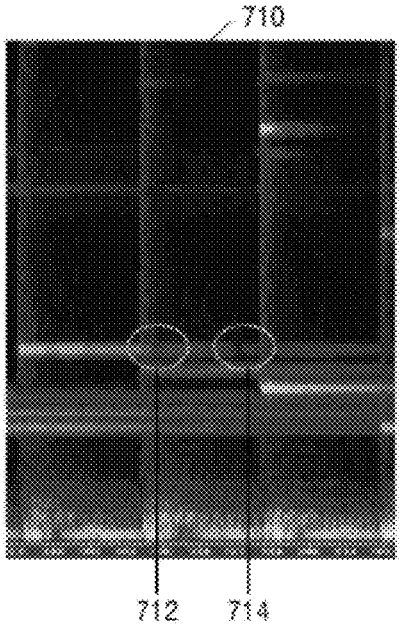
FIGS. 7A and 7B are views illustrating a final restored signal according to an exemplary embodiment.
Figure 7B:
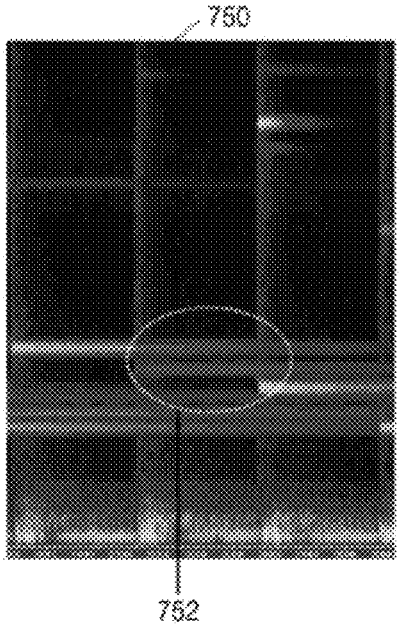

FIGS. 7A and 7B are views illustrating a final restored signal according to an exemplary embodiment.

FIG. 7A illustrates a sound spectrum of a restored signal in which a discontinuity occurs. Referring to FIG. 7A, in sections 712 and 714, a value of a restored signal is lost, and thus discontinuity occurs in the restored signal. The sound spectrum of FIG. 7A may be a sound spectrum corresponding to a restored signal output from a conventional decoding apparatus. Alternatively, the sound spectrum of FIG. 7A may be a sound spectrum corresponding to a restored signal output in operation 630 of FIG. 6, i.e., a restored signal on which operation 670 is not performed.

If discontinuity occurs as in the sections 712 and 714, a sound disconnection (i.e., a silent period) occurs when a sound signal is reproduced.

FIG. 7B illustrates a sound spectrum corresponding to a final restored signal according to exemplary embodiments. Referring to FIG. 7B, discontinuities occurring as shown in FIG. 7A are removed, and thus continuity of a signal is secured in all sections 752.

The present inventive concept can also be embodied as computer readable code or program on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, hard disks, floppy disks, flash memories, optical data storage devices, etc. The computer readable recording medium can also be distributed over network coupled computer systems so that the computer readable code is stored and executed in a distributed fashion. Moreover, the first controller 230 and the second controller 270, as well as the encoder 220 and the decoder 260 may be implemented by one or more central processing units (CPUs) either alone or in combination with one or more external memories.

While exemplary embodiments have been particularly shown and described, it will be understood by those of ordinary skill in the art that various changes in form and details may be made therein without departing from the spirit and scope of the present inventive concept as defined by the following claims.

What is claimed is:

1. A method of processing a signal, the method comprising:

restoring a down-mixed original signal using a re-quantized prediction parameter to generate a first restored signal in an encoding apparatus;

generating mute information indicating whether the down-mixed original signal has been muted, according to a value of the first restored signal; and transmitting the mute information and the down-mixed original signal from the encoding apparatus to a decoding apparatus.

2. The method of claim 1, further comprising determining whether the value of the first restored signal has a mute signal value corresponding to a mute state, wherein the generating the mute information comprises generating the mute information if the value of the first restored signal has the mute signal value.

3. The method of claim 2, wherein the determining whether the value of the first restored signal has the mute signal value comprises determining whether the value of the first restored signal has a value of 0.

4. The method of claim 1, wherein the transmitting the mute information to the decoding apparatus comprises transmitting the mute information to the decoding apparatus if the value of the first restored signal has the mute signal value.

5. The method of claim 1, further comprising:

determining a prediction parameter which is applied to up-mix the original signal in the encoding apparatus;

quantizing the prediction parameter; and re-quantizing the quantized prediction parameter to generate the re-quantized prediction parameter.

6. The method of claim 5, further comprising:

restoring the down-mixed original signal using the prediction parameter in the decoding apparatus to generate a second restored signal;

determining whether a discontinuity has occurred in the second restored signal; and changing the second restored signal according to the determination result and the mute information.

7. The method of claim 6, further comprising: if the discontinuity has occurred in the second restored signal, determining whether the original signal has been muted, based on the mute information.

8. The method of claim 7, wherein changing the second restored signal comprises: if it is determined that the original signal has not been muted, changing the value of the second restored signal in a section in which the discontinuity has occurred.

9. The method of claim 6, wherein changing the second restored signal comprises:

changing a value of the prediction parameter; and restoring the down-mixed original signal using the changed prediction parameter to generate a final restored signal.

10. The method of claim 6, wherein changing the second restored signal comprises changing the restored signal in a section in which the discontinuity has occurred, to one of the second restored signal in a previous section and the second restored signal in a subsequent section.

11. The method of claim 6, wherein changing the second restored signal comprises changing the second restored signal in a section in which the discontinuity has occurred, to a value obtained by interpolating the second restored signal in a previous section and the second restored signal in a subsequent section.

12. The method of claim 6, further comprising:

extracting the quantized prediction parameter in the decoding apparatus; and re-quantizing the quantized prediction parameter, wherein the restoration of the down-mixed original signal comprises restoring the down-mixed original signal using the re-quantized prediction parameter.

13. An encoding apparatus comprising:

a processor comprising:

an encoder configured to down-mix an original signal; and a controller configured to restore the down-mixed original signal using a re-quantized prediction parameter to generate a restored signal, generate mute information indicating whether the original signal has been muted, according to a value of the restored signal, and transmit the mute information and the down-mixed original signal to a decoding apparatus.

14. The encoding apparatus of claim 13, wherein the controller determines whether the value of the restored signal has a mute signal value corresponding to a mute state and generates the mute information if it is determined that the value of the restored signal has the mute signal value.

15. The encoding apparatus of claim 13, wherein:

the controller determines a prediction parameter which is applied to up-mix the original signal; and the encoder quantizes the prediction parameter and transmits the quantized prediction parameter to the decoding apparatus.

16. A decoding apparatus comprising:

a process comprising:

a decoder configured to receive a down-mixed original signal and mute information indicating whether an original signal has been muted and restore the down-mixed original signal using a prediction parameter; and a controller configured to determine whether a discontinuity has occurred in the restored signal and change a value of the restored signal according to the determination result and the mute information.

17. The decoding apparatus of claim 16, wherein, if it is determined that a discontinuity has occurred, the controller determines whether the original signal has been muted, based on the mute information, and changes the value of the restored signal in a section in which the discontinuity has occurred if the original signal has not been muted.

18. The decoding apparatus of claim 17, wherein the controller changes the value of the restored signal by changing a value of the prediction parameter and restores the down-mixed original signal using the changed prediction parameter.

19. The decoding apparatus of claim 17, wherein the controller changes the value of the restored signal by changing the restored signal in the section in which the discontinuity has occurred, to one of the restored signal in a previous section and the restored signal in a subsequent section.

20. The decoding apparatus of claim 16, wherein the controller changes the value of the restored signal by changing the restored signal in the section in which the discontinuity has occurred, to a value obtained by interpolating the restored signal in a previous section and the restored signal in a subsequent section.

21. A signal processing system comprising:

an encoding apparatus configured to down-mix an original signal; and a decoding apparatus configured to up-mix the down-mixed original signal to generate a final restored signal, wherein:

the encoding apparatus comprising a processor configured to up mix the down-mixed original signal using a re-quantized prediction parameter to generate a first restored signal, generate mute information indicating whether the original signal has been muted, according to a value of the first restored signal, and transmit the mute information and the down-mixed original signal to the decoding apparatus; and the decoding apparatus comprising a processor configured to restore the down-mixed original signal using the prediction parameter to generate a second restored signal, determine whether discontinuity has occurred in the second restored signal, and change the second restored signal according to the determination result and the mute information to generate the final restored signal.

22. A decoding method comprising:

receiving a down-mixed original signal and mute information that indicated whether an original signal has been muted;

restoring the down-mixed original signal to produce a restored signal;

for a least one section of a plurality of sections of the restored signal, determining whether a discontinuity has occurred in the section by comparing the value of the restored signal in the section with 0; and if a discontinuity has occurred in the section and the mute information indicates that the original signal has not been muted, changing the value of the restored signal in the section to remove the discontinuity.

* * * * *